US007198454B2

(12) United States Patent
Evans

(10) Patent No.: US 7,198,454 B2
(45) Date of Patent: Apr. 3, 2007

(54) VARIABLE STATOR VANE ARRANGEMENT FOR A COMPRESSOR

(75) Inventor: Dale E Evans, Derby (GB)

(73) Assignee: Rolls-Royce plc, London (GB)

( * ) Notice: Subject to any disclaimer, the term of this patent is extended or adjusted under 35 U.S.C. 154(b) by 181 days.

(21) Appl. No.: 10/986,389

(22) Filed: Nov. 12, 2004

(65) Prior Publication Data

US 2005/0106010 A1 May 19, 2005

(30) Foreign Application Priority Data

Nov. 14, 2003 (GB) ..... 0326544.4

(51) Int. Cl.
*F01D 9/02* (2006.01)

(52) U.S. Cl. ..... 415/12; 415/47; 415/134; 415/159

(58) Field of Classification Search ..... 415/12, 415/47, 134, 135, 136, 138, 139, 159, 160
See application file for complete search history.

(56) References Cited

U.S. PATENT DOCUMENTS

| | | | | |
|---|---|---|---|---|
| 2,923,459 A | | 2/1960 | Taylor | |
| 3,893,784 A | | 7/1975 | Zerlauth | |
| 4,430,043 A | | 2/1984 | Knight | |
| 4,812,106 A | * | 3/1989 | Purgavie | 415/139 |
| 5,601,401 A | | 2/1997 | Matheny | |

FOREIGN PATENT DOCUMENTS

| | | |
|---|---|---|
| GB | 1 499 531 | 2/1978 |
| GB | 2206381 A | 1/1989 |
| GB | 2264984 A | 9/1993 |
| JP | 2004-124797 | 4/2004 |

* cited by examiner

*Primary Examiner*—Richard A. Edgar
(74) *Attorney, Agent, or Firm*—W. Warren Taltavull; Manelli Denison & Selter PLLC

(57) ABSTRACT

An axial flow compressor (16) comprises a plurality of variable stator vanes (32) circumferentially spaced apart and extending radially. Each variable stator vane (32) is rotatably mounted on a compressor casing (28). A control ring (38) surrounds the compressor casing (28). Each variable stator vane (32) is connected to the control ring (38) by a respective one of a plurality of operating levers (40) and the control ring (38) is spaced from the compressor casing (28) by a clearance. A plurality of bimetallic strips (50) are arranged circumferentially and are positioned radially between the control ring (38) and the compressor casing (28) and the bimetallic strips (50) control the clearance between the control ring (38) and the compressor casing (28) whereby any error of the variable stator vane (32) angular position is reduced. Each bimetallic strip (50) extends radially outwardly from the compressor casing (28) towards the control ring (38). Each bimetallic strip (50) comprises a first metal strip (52) bonded to a second metal strip (54) and the first metal strip (52) has a different coefficient of thermal expansion than the second metal strip (54).

16 Claims, 3 Drawing Sheets

VARIABLE STATOR VANE ARRANGEMENT FOR A COMPRESSOR

FIELD OF THE INVENTION

The present invention relates to a variable stator vane arrangement for a compressor, and in particular to a variable stator vane arrangement for a gas turbine engine.

BACKGROUND OF THE INVENTION

The compressors of gas turbine engines are generally provided with variable stator vanes, especially compressors which have relatively high pressure ratios, to ensure that the compressor will operate efficiently over its full speed range. The variable stator vanes are used to correct the angle of incidence of the air onto a stage of rotor blades to angles which they can tolerate without a break down of flow, stall or surge at relatively low compressor pressure speeds.

A variable stator vanes angular position is controlled by an operating lever, which is connected to a control ring positioned generally coaxially with the compressor casing. The control ring is usually moved, or rotated, by a ram so as to adjust the positions of the variable stator vanes.

The control ring rotates on low friction support pads, which are mounted on the compressor casing to control the position and shape of the control ring under load.

However, if the control ring becomes distorted, or becomes eccentric, then the operating levers will move by differing amounts and the variable stator vanes will take up different angular positions. The different angular positions of the variable stator vanes affect the performance of the compressor and hence the performance of the gas turbine engine.

It is desirable to have as small a radial clearance as possible between the compressor casing, or more accurately the low friction pads, and the control ring in order to minimise error or discrepancy of the variable stator vane angular position. In operation the compressor casing temperature is higher than the control ring and therefore in operation the compressor casing expands more than the control ring, decreasing the clearance between the compressor casing and the control ring. The radial clearance is initially set to allow for tolerances and for the differential thermal growth between the compressor casing and the control ring in order to prevent binding between the control ring and the low friction pads.

These requirements result in an increased radial clearance between the compressor casing and the control ring, which increases the error or discrepancy in the variable stator vane angular position.

SUMMARY OF THE INVENTION

Accordingly the present invention seeks to provide a novel variable stator vane arrangement for an axial flow compressor which reduces the above mentioned problem.

Accordingly the present invention provides a variable stator vane arrangement for an axial flow compressor comprising a compressor casing, a plurality of variable stator vanes, a control ring, a plurality of operating levers and a plurality of circumferentially extending strips, the variable stator vanes being circumferentially spaced apart and extending radially, each variable stator vane being rotatably mounted on the compressor casing, the control ring surrounding the compressor casing, each variable stator vane being connected to the control ring by a respective one of the plurality of operating levers, the control ring being spaced from the compressor casing by a clearance, the circumferentially extending strips being arranged circumferentially and being positioned radially between the control ring and the compressor casing, the strips control the clearance between the control ring and the compressor casing whereby any error of the variable stator vane angular position is reduced.

Preferably the strips are bimetallic strips.

Preferably the bimetallic strips are arranged circumferentially on the compressor casing, the bimetallic strips extending radially outwardly from the compressor casing towards the control ring.

Preferably each bimetallic strip comprises a first metal strip bonded to a second metal strip, the first metal strip has a different coefficient of thermal expansion than the second metal strip.

Preferably the first metal strip of each bimetallic strip is arranged radially inwardly of the second metal strip.

Preferably each bimetallic strip has first end portion, a second end portion and a middle portion, the first and second end portions are circumferentially spaced, the first and second end portions are arranged to abut the compressor casing and the middle portion is spaced from the compressor casing.

Preferably the first end portion of each bimetallic strip is secured to the compressor casing and the second end portion of each bimetallic strip is secured to the compressor casing by a sliding joint.

Preferably the second end portion of the bimetallic strip has at least one circumferentially extending slot and the compressor casing has at least one member arranged to locate in the at least one slot.

Preferably the first end portion of the bimetallic strip is bonded or welded to the compressor casing.

Alternatively each strip comprises a first metal strip or a first composite strip, the first metal strip or first composite strip is secured to the compressor casing, the first metal strip or first composite strip has a different coefficient of thermal expansion than the compressor casing.

The first metal strip or first composite strip of each strip may be arranged radially outwardly of the compressor casing.

Each first metal strip or each first composite strip has first end portion, a second end portion and a middle portion, the first and second end portions are circumferentially spaced, the first and second end portions are arranged to abut the compressor casing and the middle portion is spaced from the compressor casing.

The first end portion of each first metal strip or each first composite strip is secured to the compressor casing and the second end portion of each first metal strip or each composite strip is secured to the compressor casing by a sliding joint.

The second end portion of the first metal strip or first composite strip has at least one circumferentially extending slot and the compressor casing has at least one member arranged to locate in the at least one slot.

The first end portion of the first metal strip or first composite strip is bonded or welded to the compressor casing.

The middle portion of the first metal strip or first composite strip is secured to the compressor casing by sliding joints.

Preferably there are two axially spaced circumferentially extending slots and the compressor casing has two members.

Preferably a plurality of pieces of low friction material are arranged between the control ring and the compressor casing.

Preferably each piece of low friction material is arranged between the control ring and a respective one of the strips.

DESCRIPTION OF THE DRAWINGS

The present invention will be more fully described by way of example with reference to the accompanying drawings in which:—

DESCRIPTION OF THE INVENTION

Figure 1:
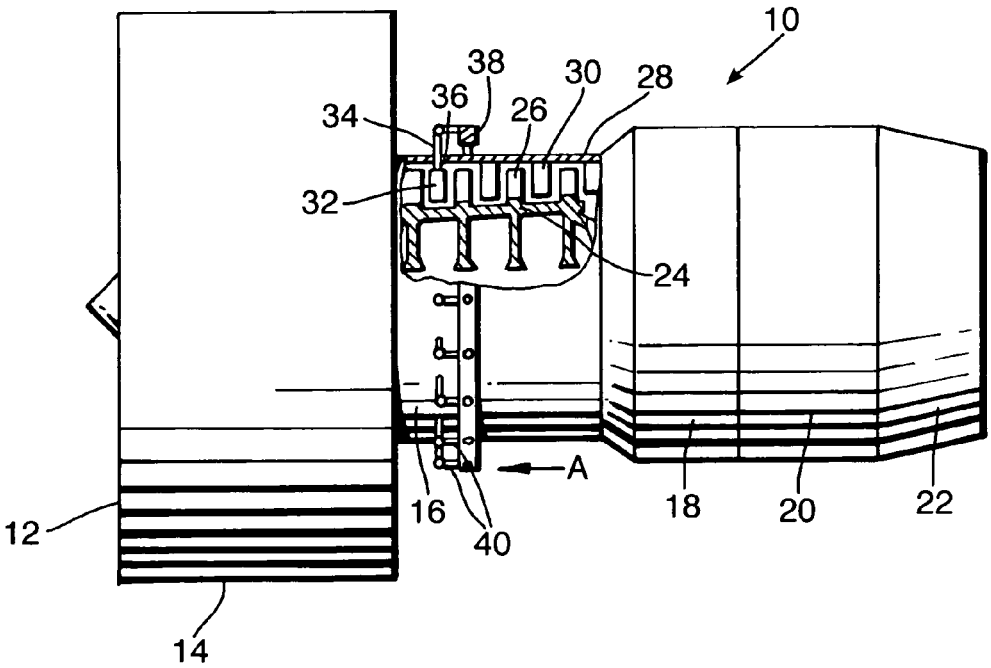
FIG. 1 is a partially cut away view of a gas turbine engine showing a variable stator vane arrangement for an axial flow compressor according to the present invention.

A turbofan gas turbine engine 10 is shown in FIG. 1, and comprises in axial flow series a fan section 14 which has an intake 12 at its upstream end, a compressor section 16, a combustion section 18, a turbine section 20 and an exhaust 22. The turbofan gas turbine engine 10 operates quite conventionally in that air is taken in through the intake 12, the air is compressed by the fan section 14 and compressor section 16 and is supplied to the combustion section 18. Fuel is injected into, and burnt in, the combustion section 18 to produce hot gases, which flow through and drive the turbine section 20 before flowing through the exhaust 22 to atmosphere. The turbines in the turbine section 20 in turn drive the fan section 14 and compressor section 16 via shafts (not shown).

The compressor section 16 comprises a rotor 24, which has a plurality of axially spaced stages of rotor blades 26. The rotor blades 26 in each stage are circumferentially spaced and extend radially outwardly from the rotor 24. A compressor casing 28 is arranged coaxially with, and surrounds, the rotor 24, the compressor casing 28 being spaced radially from the rotor blades 26 by a small tip clearance. The compressor casing 28 has a plurality of axially spaced stages of stator vanes 30. The stator vanes 30 in each stage are circumferentially spaced and extend radially inward from the compressor casing 28.

The stages of rotor blades 26 and stator vanes 30 are arranged axially alternately.

One or more of the stages of stator vanes 30, at the upstream end of the compressor section 16 comprises variable stator vanes 32, each one of which is rotatably mounted on the compressor casing 28. The variable stator vanes 32 have spindles 34 at their radially outer ends, which extend radially through respective apertures 36 in the compressor casing 28, to rotatably mount the variable stator vanes 32 on the compressor casing 28.

Figure 2:
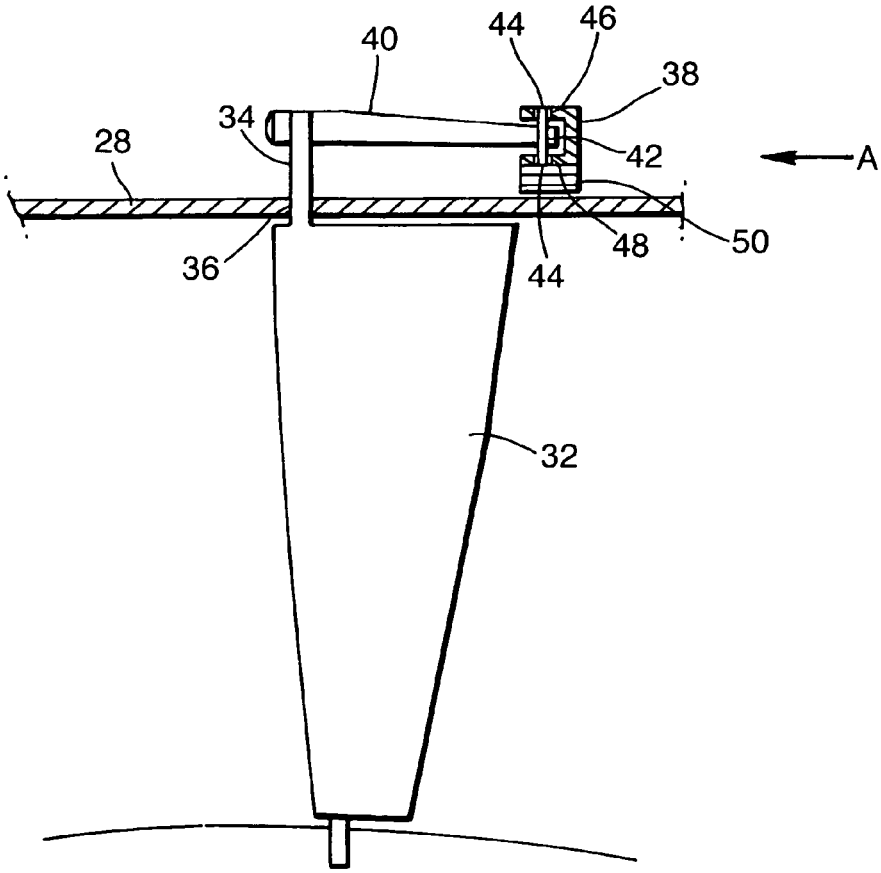
FIG. 2 is an enlarged cross-sectional view through the variable stator vane arrangement shown in FIG. 1.
Figure 3:
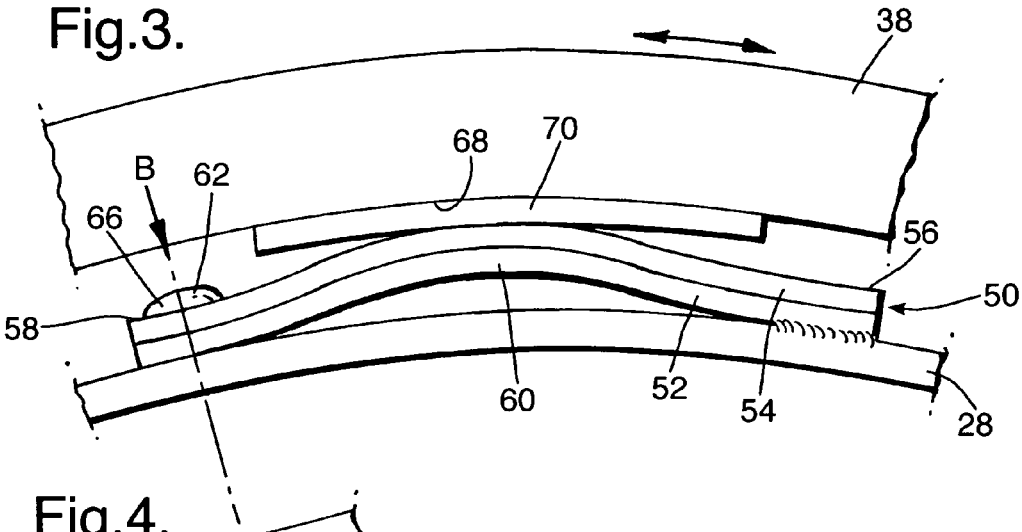
FIG. 3 is a further enlarged view in the direction of arrow A in FIG. 2.
Figure 4:
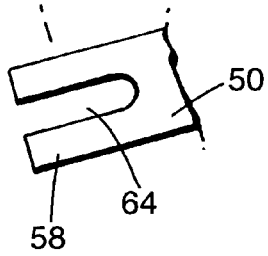
FIG. 4 is a view in the direction of arrow B in FIG. 3.

A control ring 38, as shown more clearly in FIGS. 2, 3 and 4, is arranged coaxially with, and surrounds, the compressor casing 28 and each variable stator vane 32 is connected to the control ring 38 by an operating lever 40. The operating levers 40 are rotatably mounted on the control ring 38 by radially extending spindles 42, which extend through apertures 44 in the control ring 38, and bushes 46 and 48 are provided between the spindles 42 and the control ring 38 in the apertures 44.

The control ring 38 is spaced radially from the compressor casing 28 by a clearance, and a plurality of bimetallic strips 50 are arranged circumferentially around the compressor casing 28 and the bimetallic strips 50 are positioned radially between the control ring 38 and the compressor casing 28, as shown in FIGS. 3 and 4. The bimetallic strips 50 control the clearance between the control ring 38 and the compressor casing 28. There are at least three bimetallic strips 50 equi-circumferentially spaced around the compressor casing 28. The bimetallic strips 50 extend radially outwardly from the compressor casing 28 towards the control ring 38.

Each bimetallic strip 50 comprises a first metal strip 52 bonded to a second metal strip 54 and the first metal strip 52 has a different coefficient of thermal expansion than the second metal strip 54. The first metal strip 52 of each bimetallic strip 50 is arranged radially inwardly of the second metal strip 54. Each bimetallic strip 50 has a first end portion 56, a second end portion 58 and a middle portion 60. The first and second end portions 56 and 58 of each bimetallic strip 50 are circumferentially spaced. The first and second end portions 56 and 58 of each bimetallic strip 50 is arranged to abut the compressor casing 28 and the middle portion 60 of each bimetallic strip 50 is spaced from the compressor casing 28. The first end portion 56 of each bimetallic strip 50 is secured to the compressor casing 28 and the second end portion 58 of each bimetallic strip 50 is secured to the compressor casing 28 by a sliding joint 62. The second end portion 58 of each bimetallic strip 50 has a circumferentially extending slot 64 and the compressor casing 28 has a number of circumferentially spaced members 66 arranged to locate in the slots 64 in the bimetallic members 50. The members 66 for example comprise round-headed pins.

The control ring 38 also has a plurality of low friction pads 70 circumferentially arranged on the radially inner surface 68 of the control ring 38. The number of low friction pads 70 is equal to the number of bimetallic strips 50. The bimetallic strips 50 are arranged at substantially the same angular position with respect to the compressor casing 28 as the low friction pads 70 such that the bimetallic strips 50 abut the low friction pads 70.

In operation the first end portions 56 of the bimetallic strips 50 are fixedly secured to the compressor casing 28 and hence the bimetallic strips 50 are heated by conduction of heat from the compressor casing 28. The metals of the first metal strip 52 and second metal strip 54 are selected such that the bimetallic strip 50 straightens, or flattens, as it becomes warmer. The flattening of the bimetallic strips 50 counteracts the differential thermal growth between the compressor casing 28 and the control ring 38. The bimetallic strips 50 minimise, preferably remove, the thermal contribution to the clearance between the compressor casing 28 and the control ring 38 and only a clearance for tolerances is required. Thus the clearance between the compressor casing 28 and the control ring 38 is reduced and hence the error, or discrepancy, of the variable stator vane angular position is reduced.

The bimetallic strips 50 are relatively stiff to resist normal operating loads on the control ring 38, such that the control ring 38 remains stable and concentric with the compressor casing 28. The drag on the control ring 38 is minimised by the low friction pads 70 and the low friction pads 70 are placed on the control ring 38 so as to allow heat to flow from the compressor casing 28 to the bimetallic strips 50. The bimetallic strips 50 have a width sufficient to retain the control ring 38 on the bimetallic strips 50 for all axial positions of the control ring 38 produced as a result of the rotation of the control ring 38 and operating levers 40.

The choice of metals for the first and second metal strips 52 and 54 of the bimetallic strip 50 depends upon the materials of the compressor casing 28 and the control ring 38 and upon the temperature difference between the compressor casing 28 and the control ring 38.

It may be possible for the bimetallic strip to tend to bow radially outwards as the temperature of the compressor casing increases allowing the control ring to expand more than the compressor casing.

For example a compressor without bimetallic strips may have a temperature difference of 100° C. between the compressor casing and the control ring. The initial clearance between the compressor casing, or low friction pads, and the control ring is equal to a 0.4 mm gap due to tolerance allowance and 0.5 mm gap due to temperature difference between the compressor casing and the control ring to avoid binding during operation. The angles of the variable stator vanes could vary up to +/−0.25° around the control ring/compressor casing as a result of distortion of the control ring due to increased clearance between the compressor casing and the control ring.

The present invention reduces or removes the additional gap of 0.5 mm for the temperature difference.

The compressor casing may comprise titanium, titanium alloy, steel, etc and the control ring may comprises titanium, titanium alloy, steel, aluminium, aluminium alloy or a composite material.

Figure 5:
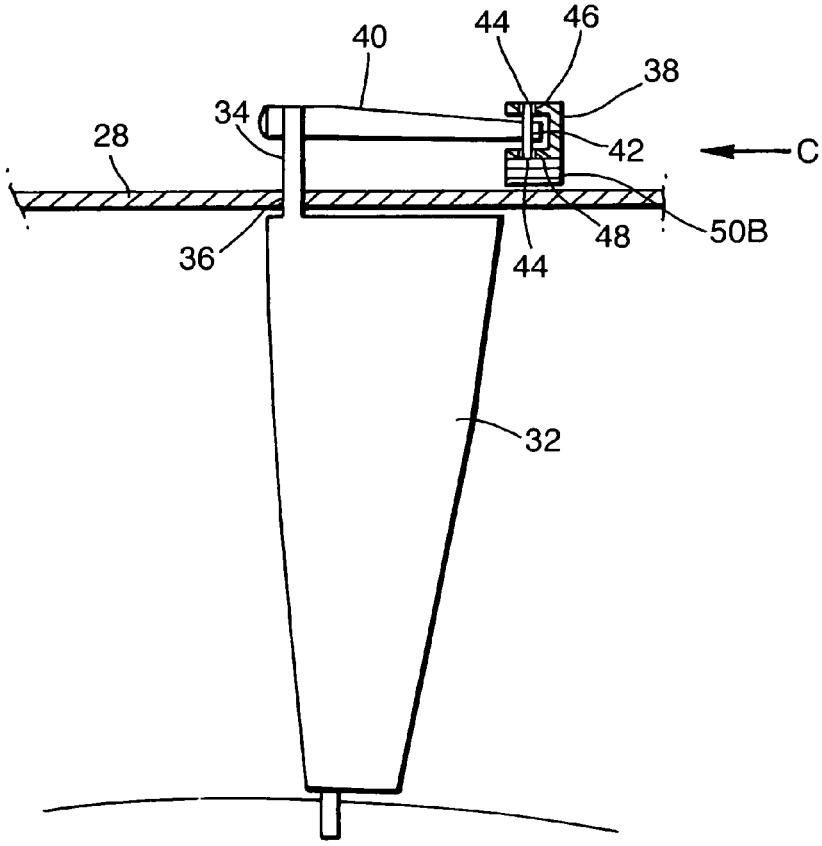
FIG. 5 is an alternative enlarged cross-sectional view through the variable stator vane arrangement shown in FIG. 1.
Figure 6:
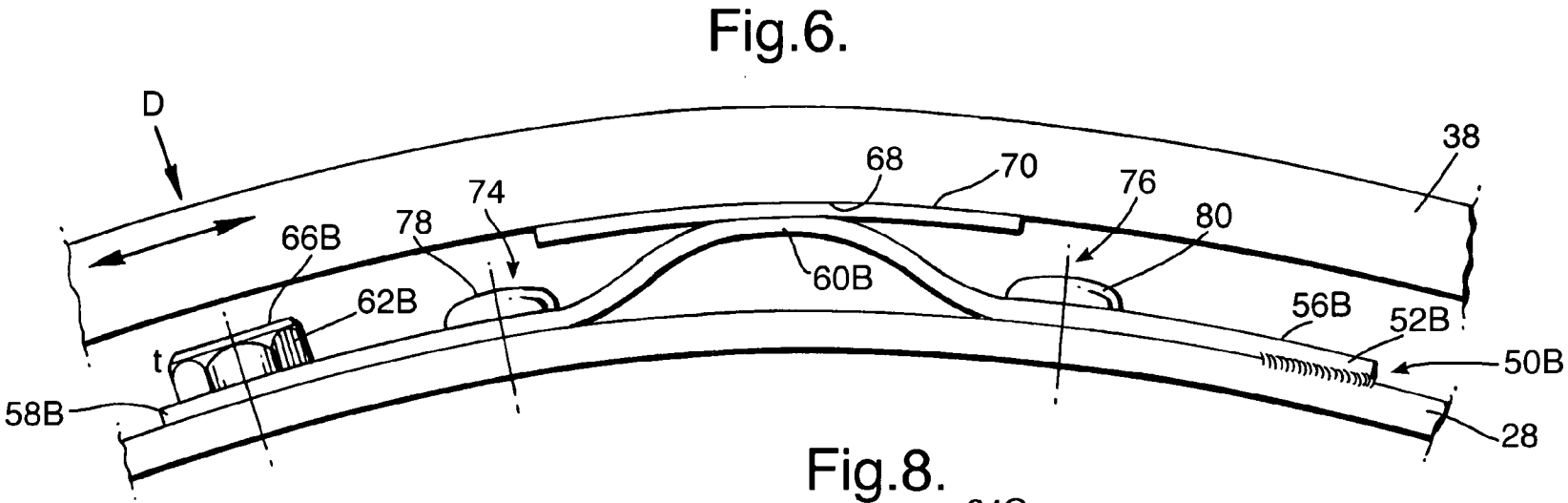
FIG. 6 is a further enlarged view in the direction of arrow C in FIG. 5.
Figure 7:
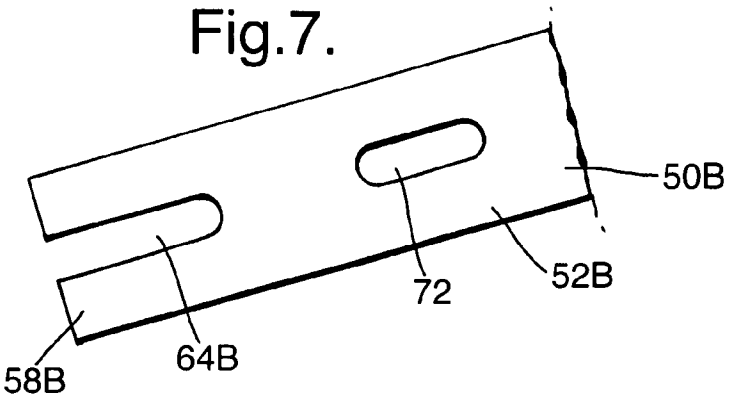
FIG. 7 is a view in the direction of arrow D in FIG. 6.

An alternative control ring 38, as shown more clearly in FIGS. 5, 6 and 7, is arranged coaxially with, and surrounds, the compressor casing 28 and each variable stator vane 32 is connected to the control ring 38 by an operating lever 40. The operating levers 40 are rotatably mounted on the control ring 38 by radially extending spindles 42, which extend through apertures 44 in the control ring 38, and bushes 46 and 48 are provided between the spindles 42 and the control ring 38 in the apertures 44.

The control ring 38 is spaced radially from the compressor casing 28 by a clearance, and a plurality of strips 50B are arranged circumferentially around the compressor casing 28 and the strips 50B are positioned radially between the control ring 38 and the compressor casing 28, as shown in FIGS. 6 and 7. The strips 50B control the clearance between the control ring 38 and the compressor casing 28. There are at least three strips 50B equi-circumferentially spaced around the compressor casing 28. The strips 50B extend radially outwardly from the compressor casing 28 towards the control ring 38.

Each strip 50B comprises a first metal strip 52B attached to the compressor casing 28 and the first metal strip 52B has a different coefficient of thermal expansion than the compressor casing 28. In effect the compressor casing 28 forms a second metal strip of a bimetallic strip with the strip 50B. The first metal strip 52B of each strip 50B is arranged radially outwardly of the compressor casing 28. Each first metal strip 52B has a first end portion 56B, a second end portion 58B and a middle portion 60B. The first and second end portions 56B and 58B of each first metal strip 52B are circumferentially spaced. The first and second end portions 56B and 58B of each first metal strip 52B are arranged to abut the compressor casing 28 and the middle portion 60B of each first metal strip 52B is spaced from the compressor casing 28. The first metal strip 52B is pre-formed such that the middle portion 60B is arched. The first end portion 56B of each first metal strip 52B is secured to the compressor casing 28 and the second end portion 58B of each first metal strip 52B is secured to the compressor casing 28 by a sliding joint 62B. The second end portion 58B of each first metal strip 52B has a circumferentially extending slot 64B and the compressor casing 28 has a number of circumferentially spaced members 66B arranged to locate in the slots 64B in the first metal strips 52B. The members 66B for example comprise bolts to lock the sliding joint 62B as required.

Each first metal strip 52B is also secured to the compressor casing 28 by two circumferentially spaced sliding joints 74 and 76. The sliding joints 74 and 76 are arranged immediately on the opposite sides of the middle portion 60B of the first metal strip 52B. The sliding joints 74 and 76 comprise a circumferentially extending slot 72, at each position, in the first metal strip 52B and a member 78 and 80 on the compressor casing 28. The members 78 and 80 for example comprise round-headed pins.

The control ring 38 also has a plurality of low friction pads 70 circumferentially arranged on the radially inner surface 68 of the control ring 38. The number of low friction pads 70 is equal to the number of strips 50B. The strips 50B are arranged at substantially the same angular position with respect to the compressor casing 28 as the low friction pads 70 such that the strips 50B abut the low friction pads 70.

During assembly of the control ring 38 onto the compressor section 16 the bolt 66B is loose and the control ring 38 depresses the first metal strip 52B slightly for all tolerance conditions. The first metal strip 52B is displaced circumferentially around the compressor casing 28 and is then locked by tightening the bolt 66B. This provides an automatic adjustment for component tolerances, which ensures there is no build clearance. Locking the bolt 66B locks the first metal strip 52B and ensures that the control ring 38 remains stable and concentric with the compressor casing 28 under load during operation, with a sliding contact at the low friction pads 70.

In operation the first end portions 56B of the first metal strips 52B are fixedly secured to the compressor casing 28 and hence the strips 50B are heated by conduction of heat from the compressor casing 28. The metals of the first metal strip 52B and the compressor casing 28 are selected such that the first metal strip 52B straightens, or flattens, as it becomes warmer. The flattening of the first metal strips 52B counteracts the differential thermal growth between the compressor casing 28 and the control ring 38. The strips 50B minimise, preferably cancels out, the thermal contribution to the clearance between the compressor casing 28 and the control ring 38. Both tolerance and thermal effects have been addressed. Thus the clearance between the compressor casing 28 and the control ring 38 is minimised and hence the error, or discrepancy, of the variable stator vane angular position is minimised.

The first metal strips 52B are relatively stiff to resist normal operating loads on the control ring 38, such that the control ring 38 remains stable and concentric with the compressor casing 28. The drag on the control ring 38 is minimised by the low friction pads 70 and the low friction pads 70 are placed on the control ring 38 so as to allow heat to flow from the compressor casing 28 to the first metal strips 52B. The first metal strips 52B have a width sufficient to retain the control ring 38 on the first metal strips 52B for all axial positions of the control ring 38 produced as a result of the rotation of the control ring 38 and operating levers 40.

The choice of metals for the first metal strips 52B of the strip 50B depends upon the materials of the compressor casing 28 and the control ring 38 and upon the temperature difference between the compressor casing 28 and the control ring 38.

Thus in this embodiment each strip comprises only one metal strip and the compressor casing itself effectively forms the second metal strip of a bimetallic strip. The first metal strip is made sufficiently long around the circumference of the compressor casing and the first metal strip is made of lower coefficient of thermal expansion such that the first metal strip tends to flatten as the temperature of the compressor casing increases allowing the compressor casing to expand more than the control ring. It may be possible for the first metal strip to have a higher coefficient of expansion than the compressor casing so that the first metal strip tends to bow radially outwards as the temperature of the compressor casing increases allowing the control ring to expand more than the compressor casing.

Figure 8:
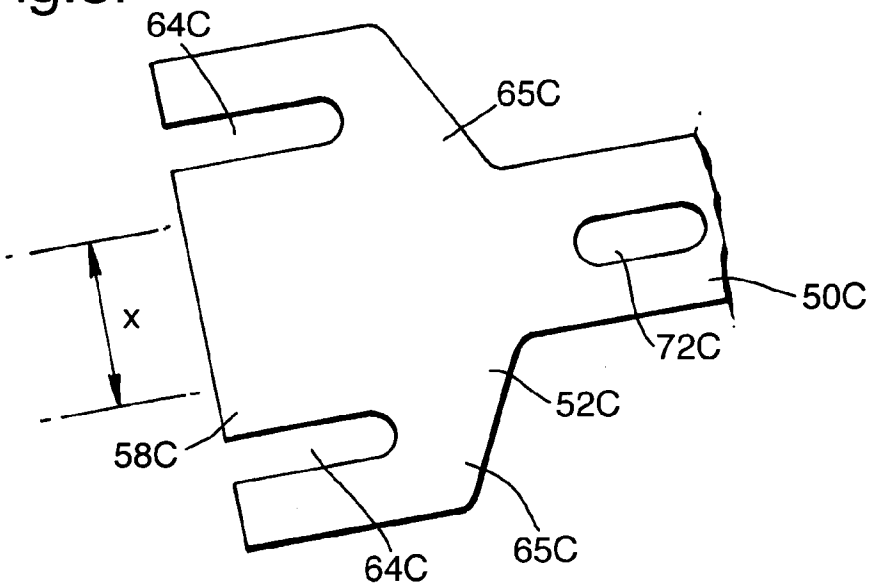
FIG. 8 is an alternative view in the direction of arrow D in FIG. 6.

In FIG. 8 alternative first metal strips 52C are provided in which the second end portion 58C of each first metal strip 52C has two circumferentially extending slots 64C and the compressor casing 28 has a number of circumferentially spaced members arranged to locate in axially spaced slots 64C in the first metal strips 52C. The slots 64C are provided in axial projections 65C on the second end portions 58C of the first metal strips 52C. The members for example comprise bolts to lock the sliding joints 62C as required. This provides a dual sided failsafe fastener arrangement in which the bolts are provided in the slots 64C in the axial projections 65C on both sides of the control ring 38 and are not under the control ring 38 and this enables easier access to the bolts for locking and unlocking. This also allows the radial space between the control ring 38 and the compressor casing 28 to be reduced where radial space is limited to provide a more compact arrangement. The slots 64C and bolts are arranged to be outside the range of axial movement X of the control ring 38.

The arrangement shown in FIG. 8 may also be used in the embodiment shown in FIGS. 2 and 3.

In the arrangement shown in FIGS. 5, 6 and 7 the strips 50B may alternatively comprise first composite strips 52B because the lower expansion coefficient of the composite material provides the same effect of the first composite strips 52B expanding less than the compressor casing 38 and heat conduction into from the compressor casing 83 to the first composite strips 52B is not essential.

The advantage of the present invention is that it provides better control of the angles of the variable stator vanes. This results in an increase in the performance of the compressor and hence the gas turbine engine. It also improves the integrity of the downstream stage of rotor blades due to the reduction, or removal, of differential wakes from the variable stator vanes. Additionally, the control rings may be made of lighter weight material, lower expansion coefficient material, lower cost material for example composite material and avoid the need to stiffen the control ring to stabilise the control ring in response to large clearances between the compressor casing and the control ring.

Thus the present invention uses the difference in the expansion coefficient between the circumferentially extending strip and the compressor casing to control the radial clearance between the compressor casing and the control ring.

I claim:

1. A variable stator vane arrangement for an axial flow compressor comprising a compressor casing, a plurality of variable stator vanes, a control ring, a plurality of operating levers and a plurality of circumferentially extending strips, the variable stator vanes being circumferentially spaced apart and extending radially, each variable stator vane being rotatably mounted on the compressor casing, the control ring surrounding the compressor casing, each variable stator vane being connected to the control ring by a respective one of the plurality of operating levers, the control ring being spaced from the compressor casing by a clearance, the circumferentially extending strips being arranged circumferentially and being positioned radially between the control ring and the compressor casing, the strips controlling the clearance between the control ring and the compressor casing whereby any error of the variable stator vane angular position is reduced wherein said strips are bimetallic strips.

2. A variable stator vane arrangement as claimed in claim 1 wherein the bimetallic strips are arranged circumferentially on the compressor casing, the bimetallic strips extending radially outwardly from the compressor casing towards the control ring.

3. A variable stator vane arrangement as claimed in claim 1 wherein each bimetallic strip comprises a first metal strip bonded to a second metal strip, the first metal strip having a different coefficient of thermal expansion from the second metal strip.

4. A variable stator vane arrangement as claimed in claim 3 wherein the first metal strip of each bimetallic strip is arranged radially inwardly of the second metal strip.

5. A variable stator vane arrangement as claimed in claim 4 wherein each bimetallic strip has a first end portion, a second end portion and a middle portion, the first and second end portions being circumferentially spaced, the first and second end portions being arranged to abut the compressor casing and the middle portion being spaced from the compressor casing.

6. A variable stator vane arrangement as claimed in claim 5 wherein the first end portion of each bimetallic strip is secured to the compressor casing and the second end portion of each bimetallic strip is secured to the compressor casing by a sliding joint.

7. A variable stator vane arrangement as claimed in claim 6 wherein the second end portion of the bimetallic strip has at least one circumferentially extending slot and the compressor casing has at least one member arranged to locate in the at least one slot.

8. A variable stator vane arrangement as claimed in claim 7 wherein there are two axially spaced circumferentially extending slots and the compressor casing has two members.

9. A variable stator vane arrangement as claimed in claim 6 wherein the first end portion of the bimetallic strip is bonded or welded to the compressor casing.

10. A variable stator vane arrangement as claimed in claim 1 wherein each strip comprises a first metal strip or a first composite strip, the first metal strip or first composite strip being secured to the compressor casing, the first metal strip or first composite strip has a different coefficient of thermal expansion from the compressor casing.

11. A variable stator vane arrangement as claimed in claim 10 wherein the first metal strip or first composite strip of each strip is arranged radially outwardly of the compressor casing.

12. A variable stator vane arrangement as claimed in claim 11 wherein each first metal strip or each first composite strip has first end portion, a second end portion and a middle portion, the first and second end portions being circumferentially spaced, the first and second end portions being arranged to abut the compressor casing and the middle portion is spaced from the compressor casing.

13. A variable stator vane arrangement as claimed in claim 12 wherein the first end portion of each first metal strip or each first composite strip is secured to the compressor casing and the second end portion of each first metal strip or each first composite strip is secured to the compressor casing by a sliding joint.

14. A variable stator vane arrangement as claimed in claim 13 wherein the second end portion of the first metal strip or first composite strip has at least one circumferentially extending slot and the compressor casing has at least one member arranged to locate in the at least one slot.

15. A variable stator vane arrangement as claimed in claim 13 wherein the first end portion of the first metal strip or first composite strip is bonded or welded to the compressor casing.

16. A variable stator vane arrangement as claimed in any claim 13 wherein the middle portion of the first metal strip or first composite strip is secured to the compressor casing by sliding joints.

* * * * *